US007029341B2

(12) United States Patent
Fuse et al.

(10) Patent No.: US 7,029,341 B2
(45) Date of Patent: Apr. 18, 2006

(54) WATER JET PROPULSION BOAT HAVING IMPROVED RIDE PLATE

(75) Inventors: Tomohiro Fuse, Wako (JP); Hisashi Matsuo, Wako (JP); Hiroshi Iwakami, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/085,204

(22) Filed: Mar. 22, 2005

(65) Prior Publication Data

US 2005/0221694 A1 Oct. 6, 2005

(30) Foreign Application Priority Data

Mar. 31, 2004 (JP) ..... 2004-104566

(51) Int. Cl.
*B63H 11/00* (2006.01)

(52) U.S. Cl. ..... 440/38

(58) Field of Classification Search ..... 440/38, 440/47

See application file for complete search history.

(56) References Cited

U.S. PATENT DOCUMENTS

| | | | | |
|---|---|---|---|---|
| 5,460,553 | A * | 10/1995 | Craig et al. | 440/38 |
| RE35,351 | E * | 10/1996 | Morgan | 440/47 |
| 6,066,014 | A * | 5/2000 | Smith et al. | 440/89 R |
| 2003/0064637 | A1 * | 4/2003 | Fuse et al. | 440/38 |
| 2003/0153219 | A1 * | 8/2003 | Menard et al. | 440/88 HE |

FOREIGN PATENT DOCUMENTS

JP 10-129583 5/1998

* cited by examiner

*Primary Examiner*—Stephen Avila
(74) *Attorney, Agent, or Firm*—Westerman, Hattori, Daniels & Adrian, LLP.

(57) ABSTRACT

A water jet propulsion boat includes a pump chamber provided at a rear portion of a boat body of the boat. Further, a water jet pump is disposed in the pump chamber and a ride plate closes a bottom of the pump chamber. The ride plate includes a base fixable to the boat body. A setting plate detachably fixed to the base, and forms part of a bottom surface of the rear portion of the boat body.

4 Claims, 7 Drawing Sheets

WATER JET PROPULSION BOAT HAVING IMPROVED RIDE PLATE

FIELD OF THE INVENTION

The present invention relates to a water jet propulsion boat which travels forward by thrust of water projected from a water jet pump provided at the rear portion of a boat body. More specifically, the invention relates to an improved ride plate that closes the bottom of a pump chamber.

RELATED ART

In the related art, a water jet propulsion boat in which a pump chamber is provided at the rear portion of a boat body, a water jet pump is accommodated in the pump chamber, and the bottom of the pump chamber is closed by a ride plate (ship bottom plate (37)) is known (for example, see Patent Document JP-A-10-129583).

Since the bottom surface of a ride plate constitutes part of the bottom surface of the rear portion of a boat body, the shape of the bottom surface of the ride plate affects much the traveling performance and turning performance of a water jet propulsion boat.

The ride plate in the related art is composed of a single component, and is fixed directly to the boat body.

Therefore, there is a problem that when an attempt is made to improve the traveling performance or the turning performance, the entire ride plate is forced to be manufactured again and replaced with a new one.

It is an object of the present invention to solve the above-described problem, and to provide a water jet propulsion boat in which the traveling performance and the turning performance can be improved without manufacturing and replacing the entire ride plate.

SUMMARY OF THE INVENTION

In order to achieve the aforementioned object, a water jet propulsion boat according to the present invention includes a pump chamber provided at the rear portion of the boat body, a water jet pump accommodated in the pump chamber, and a ride plate closing the bottom of the pump chamber, wherein the ride plate includes a base to be fixed to the boat body, and a setting part detachably fixed to the base, and forming part of the bottom surface of the rear portion of the boat body.

Preferably, the setting part is fixed under the base so that the bottom surface of the setting part constitutes part of the bottom surface of the rear portion of the boat body.

Preferably, the base includes a pair of left and right bases, and the setting part includes a pair of left and right side parts to be fixed to the base and a center part to be detachably fixed to the side parts.

Since the water jet propulsion boat of the present invention includes a pump chamber at the rear portion of a boat body, a water jet pump accommodated in the pump chamber, and a ride plate closing the bottom of the pump chamber, and is characterized that the ride plate includes a base to be fixed to the boat body, and a setting part detachably fixed to the base and constituting part of the bottom surface of the rear portion of the boat body the following effects are achieved.

When an attempt is made to improve the traveling performance or turning performance of the water jet propulsion boat, it is not necessary to newly manufacture and replace the entire ride plate itself any longer. The traveling performance and/or the turning performance of the water jet propulsion boat can be improved by manufacturing and replacing only the setting part.

In addition, by attaching a suitable setting part (smaller than the entire ride plate) depending on the machine type of the water jet propulsion boat, the performance specific to each type of boats can easily be exploited.

Furthermore, by fixing the setting part under the base, and constituting part of the bottom surface of the rear portion of the boat body by the bottom surfaces of the setting part, a preferable sliding surface can easily be obtained.

Still further, by constituting the base by a pair of left and right bases, and constituting the setting part by a pair of left and right side parts to be fixed to the base and a center part to be detachably fixed to the side parts, steering stability and improvement of the maximum speed can easily be achieved by replacing only the center part constituting the center portion which affects the steering stability and the maximum speed very much.

In other words, by replacing only the center part, which is much smaller than the entire ride plate, the steering stability and improvement of the maximum speed can easily be achieved.

BRIEF DESCRIPTION OF THE DRAWINGS

A preferred embodiment of the present invention will be described with reference to the accompanying drawings, wherein.

DETAILED DESCRIPTION OF THE INVENTION

Figure 1:
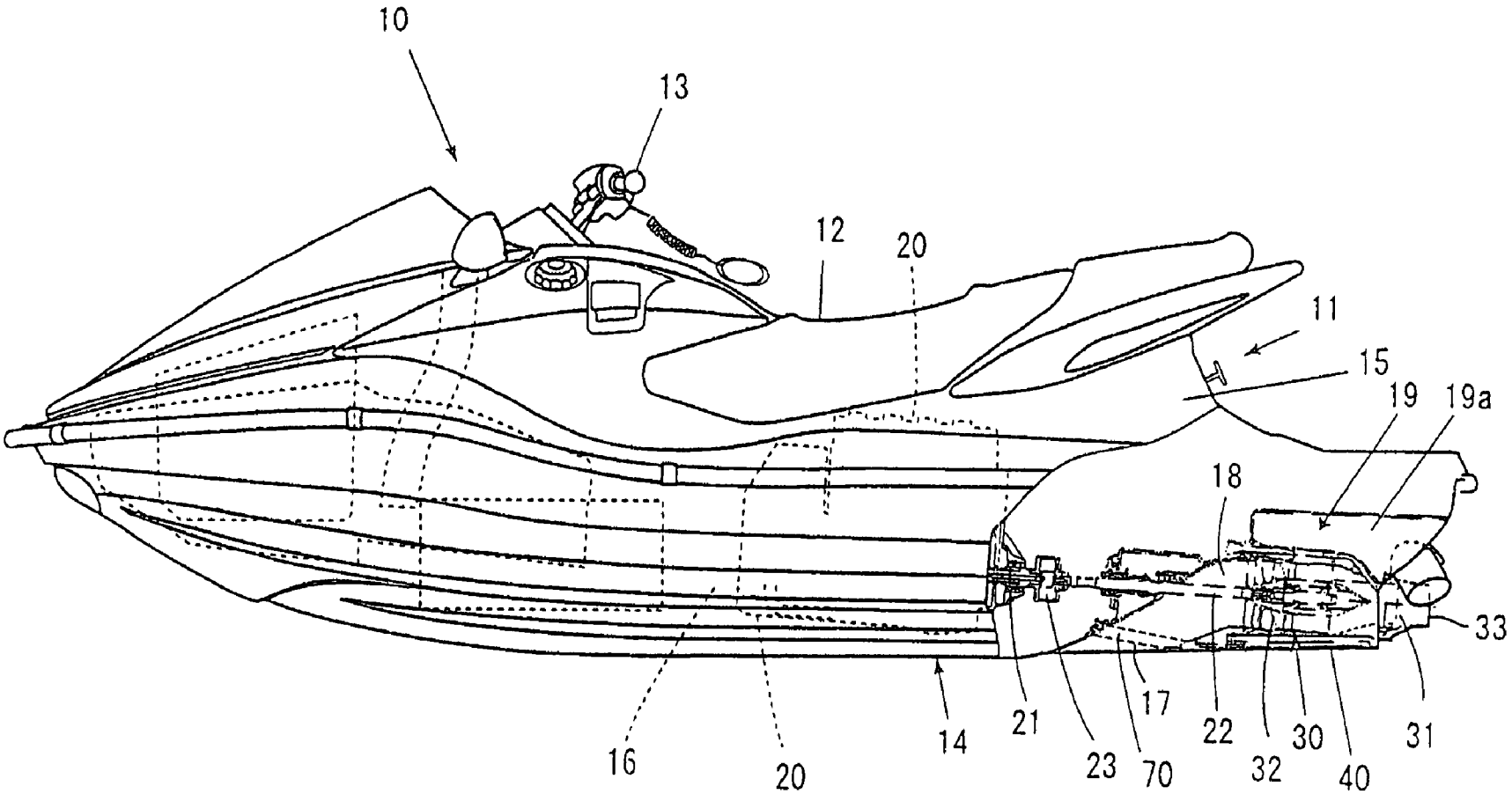
FIG. 1 is a schematic side view, partly broken, showing an embodiment of a water jet propulsion boat according to the present invention.

Referring now to the drawings, embodiments of the present invention will be described.

Figure 2:
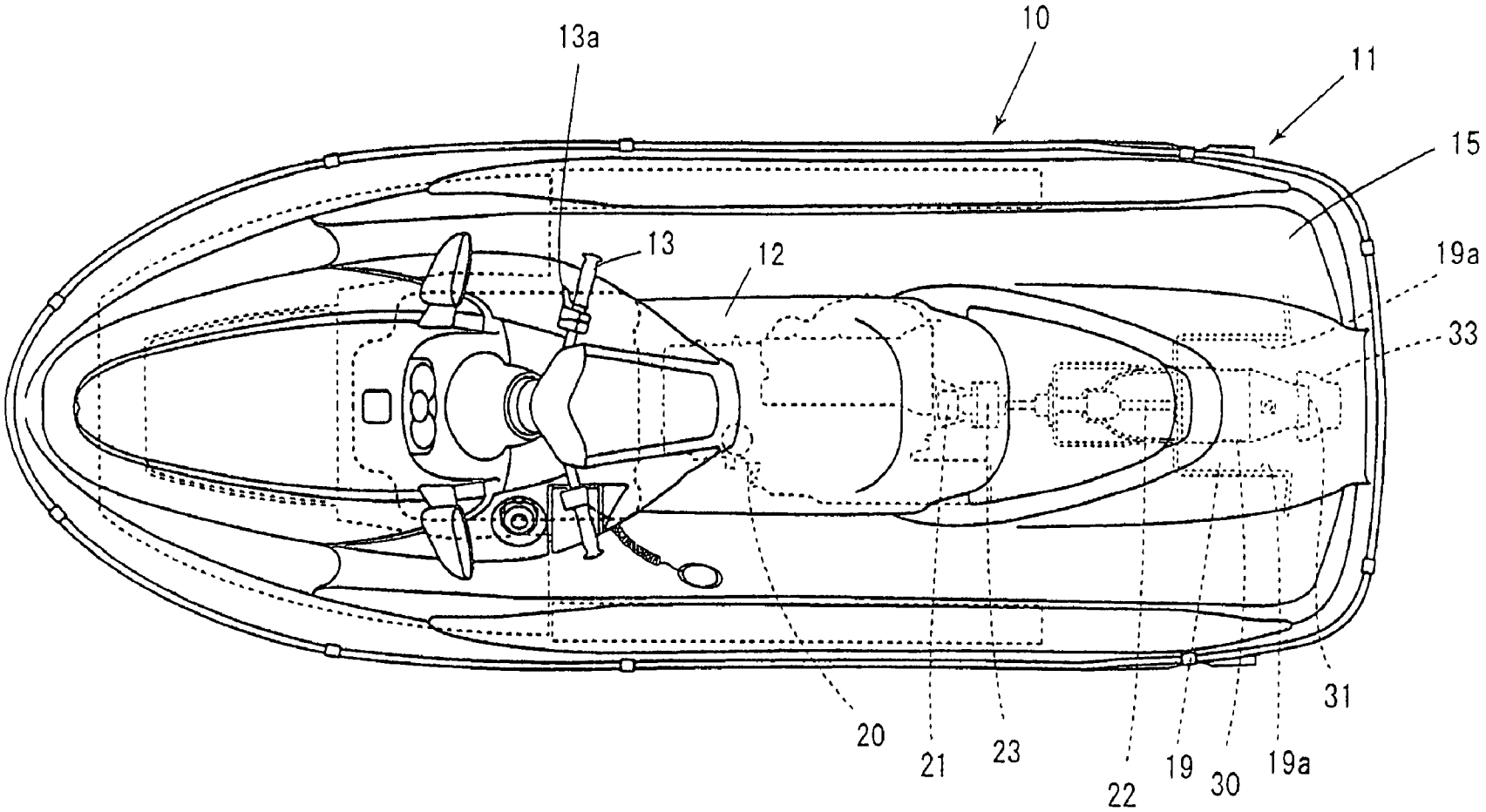
FIG. 2 is a schematic plan view of the same.

FIG. 1 is a schematic side view, partly broken, showing an embodiment of a water jet propulsion boat according to the present invention, and FIG. 2 is a schematic plan view of the same.

As shown in these drawings (mainly in FIG. 1), a water jet propulsion boat 10 is a saddle type small boat in which an occupant can sit on a seat 12 of a boat body 11 and steer by gripping a steering handle 13 with a throttle lever.

The boat body 11 is of a floating structure formed by joining a hull 14 and a deck 15 so as to form a space 16 inside. In the space 16, an engine 20 is mounted on the hull 14, and a water jet pump (hereinafter, simply referred to as a jet pump) 30 as propulsion means to be driven by the engine 20 is accommodated in a pump chamber 19 provided at the rear portion of the hull 14.

The jet pump 30 includes an impeller 32 which is disposed in a flow path 18 formed from a water-inlet port 17 opening on the bottom of the boat to an injection port 31 opening at the rear end of the boat body and a steering nozzle 33, and a shaft (drive shaft) 22 for driving the impeller 32 is connected to an output shaft 21 of the engine 20 via a coupler 23. Therefore, when the impeller 32 is driven to rotate by the engine 20 via the coupler 23 and the drive shaft 22, water taken from the water-inlet port 17 is directed from the injection port 31 through the steering nozzle 33, whereby the boat body 11 is propelled. The number of revolution of the engine 20, that is, the propulsion force generated by the jet pump 30 is operated by rotating a throttle lever 13*a* (see FIG. 2) of the operating handle 13. The steering nozzle 33 is linked with the operating handle 13 by an operating wire, not shown, and is rotated by the operation of the handle 13, whereby the course of the boat body 11 can be changed.

The bottom of the pump chamber 19 in which the jet pump 30 is accommodated is closed by a ride plate 40.

Figure 3:
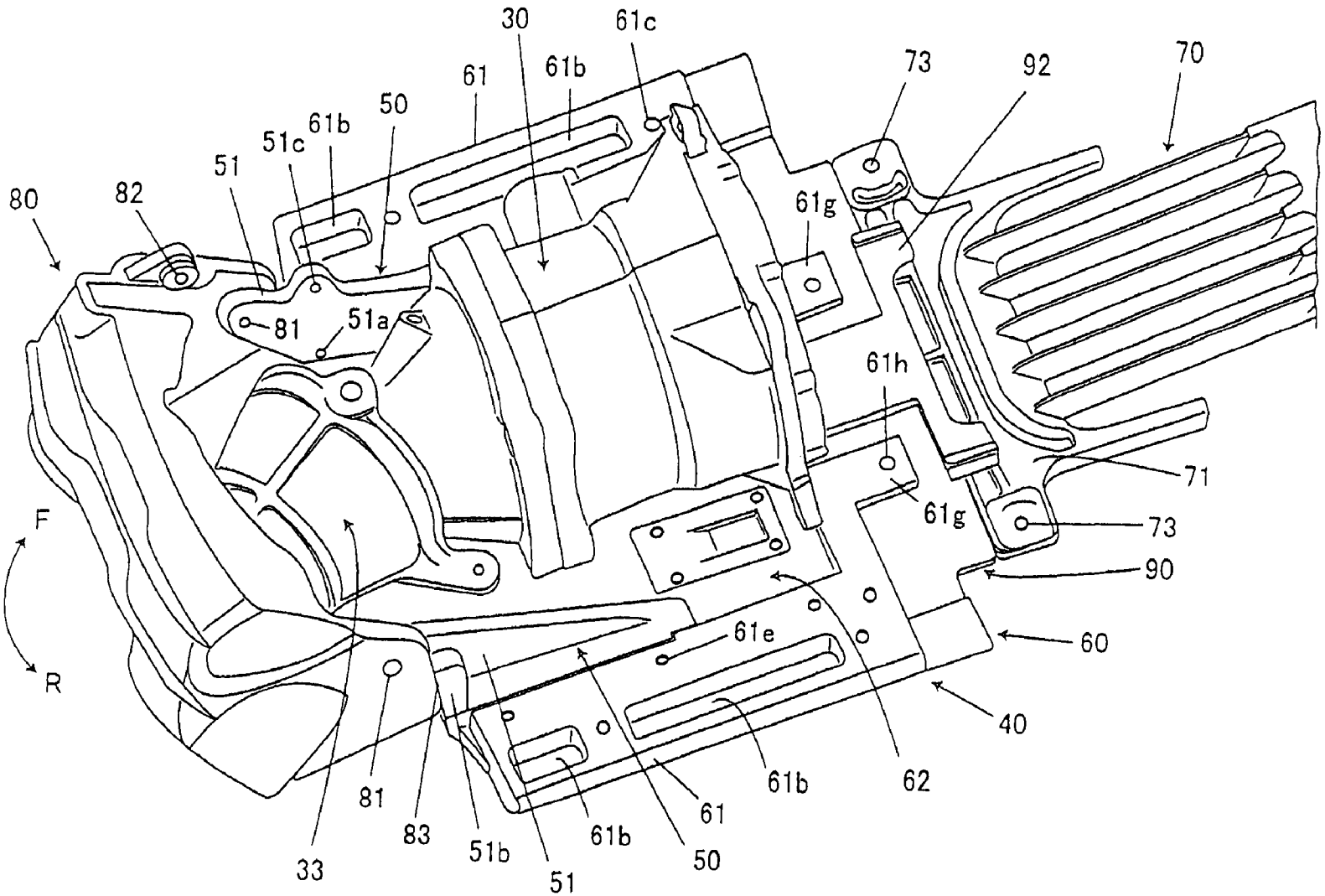
FIG. 3 is a perspective view of a jet pump and a ride plate when viewed obliquely from above.
Figure 4:
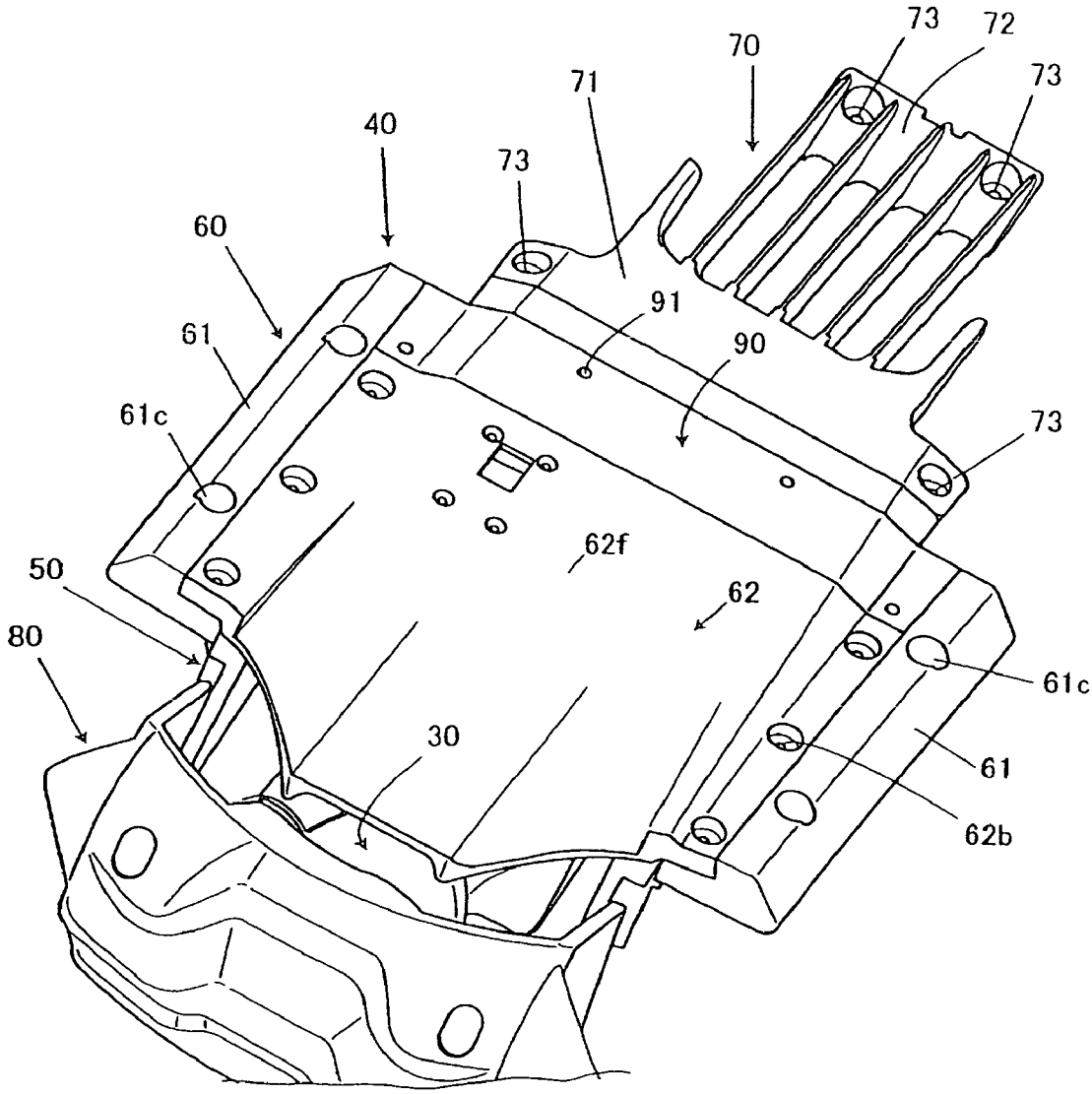
FIG. 4 is a perspective view of the same when viewed obliquely from below.
Figure 5:
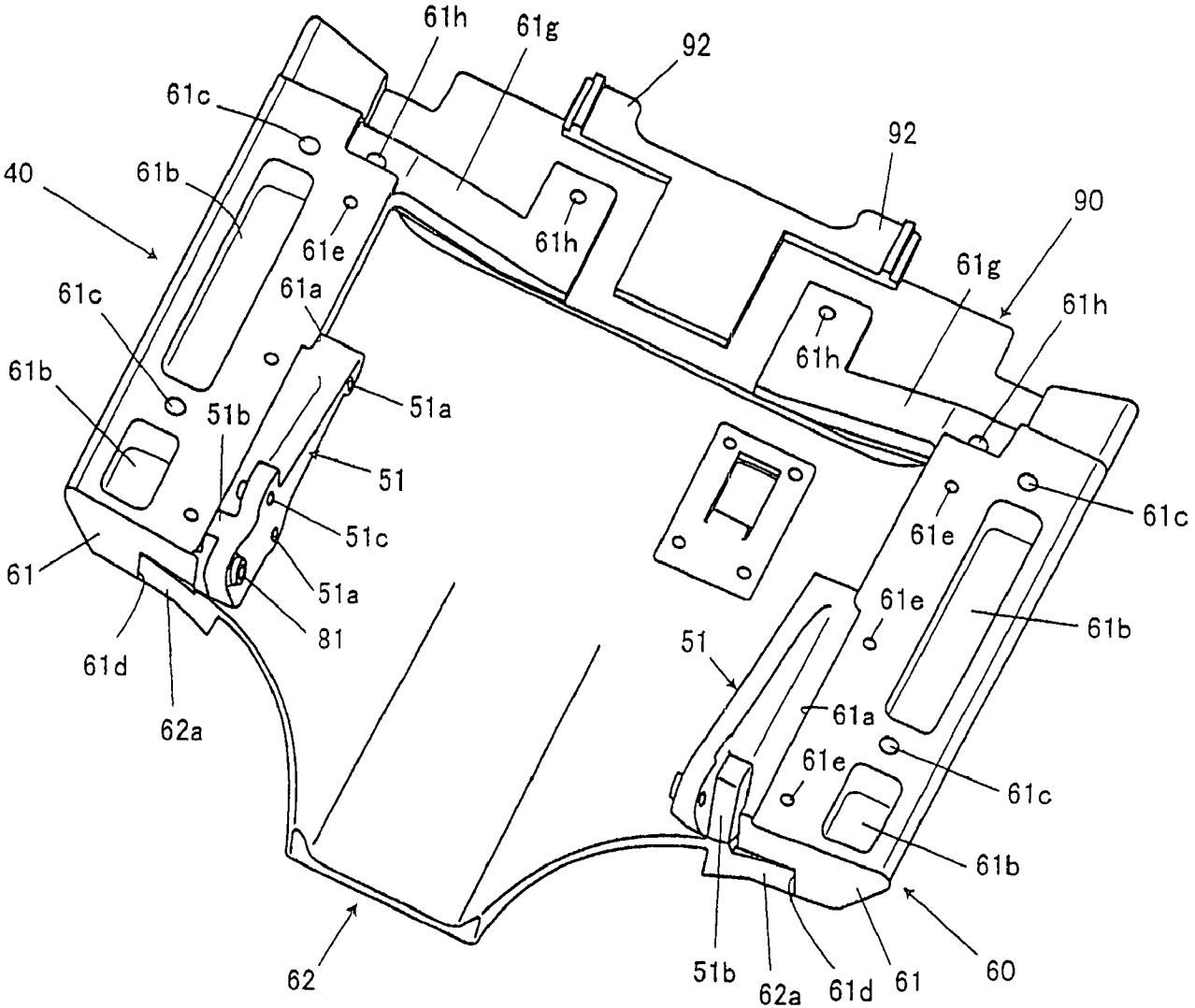
FIG. 5 is a perspective view of the ride plate when viewed obliquely from above.
Figure 6:
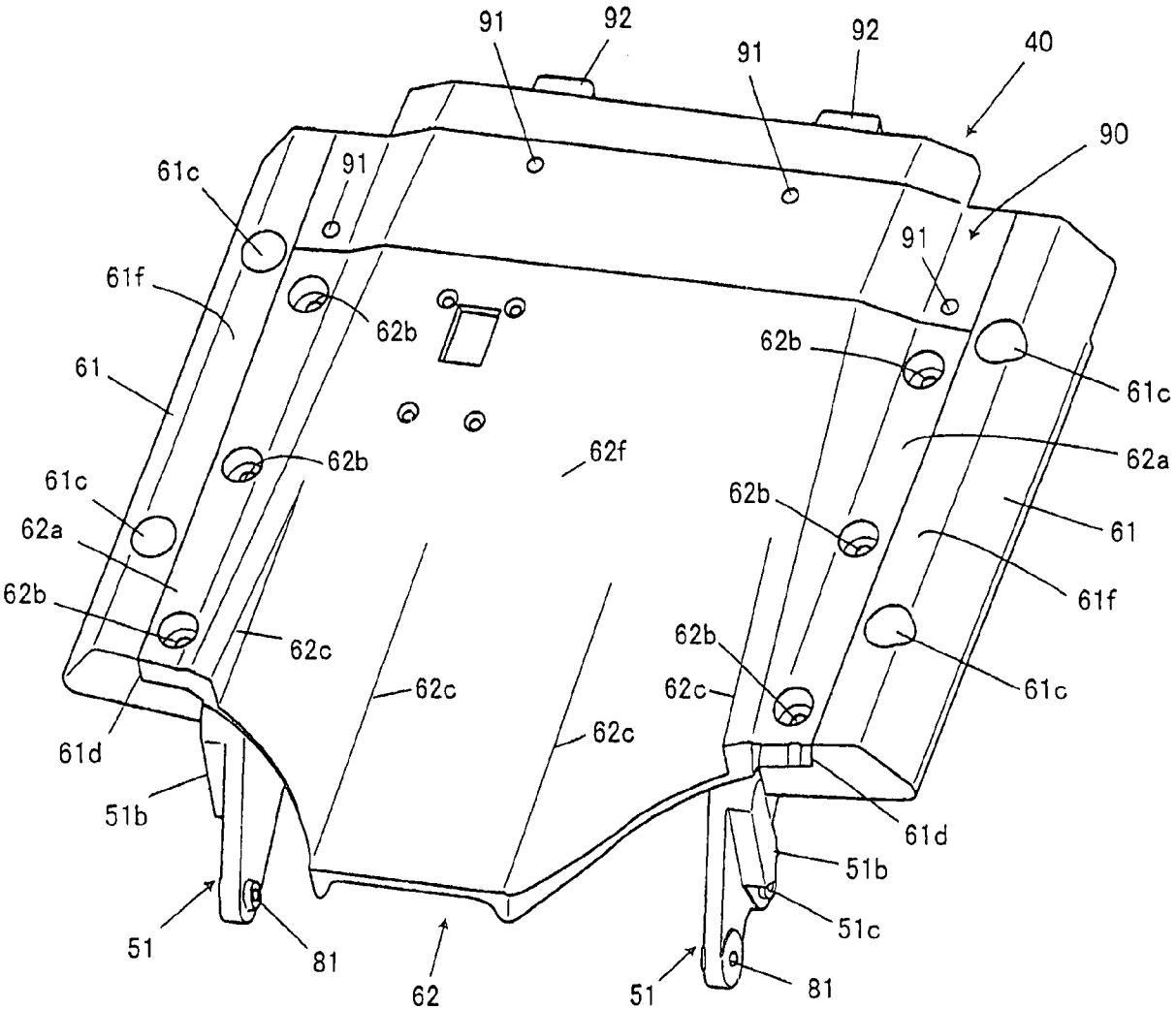
FIG. 6 is a perspective view of the same when viewed obliquely from below.

FIG. 3 is a perspective view of the jet pump 30 and the ride plate 40 when viewed from obliquely above, FIG. 4 is a perspective view of the same when viewed from obliquely below, FIG. 5 is a perspective view of the ride plate 40 when viewed from obliquely above, and FIG. 6 is a perspective view of the same when viewed from obliquely below.

As shown in the drawings, the ride plate 40 includes a base 50(51) and a setting part 60.

The base 50 is composed of a pair of left and right supporting members 51 and a pair of left and right base-and-side parts (hereinafter, also referred simply as side parts) 61 detachably fixed to the supporting members 51.

The setting part 60 includes the pair of side parts 61, and a center part 62 to be detachably fixed to the side parts 61.

In FIG. 3 and FIG. 4, reference numeral 70 designates a foreign material preventing plate to be disposed at the water-inlet port 17 shown in FIG. 1, and reference numeral 80 designates a deflector which is located behind the steering nozzle 33 for directing jet water flow toward the front when moving the boat body 11 backward.

As shown in FIG. 5, bolt holes (through-holes) 51*a*, 51*a* are formed below the pair of supporting members 51, and female screw holes (not shown) opposing the above-described bolt holes 51*a* are formed on inside surfaces 61*a* of the side parts 61. The supporting members 51 and the side parts 61 are fixed to each other by inserting bolts, not shown, into these bolt holes and tightening the same.

The outer surfaces of the supporting members 51 are formed with projections 51*b* for positioning the supporting members 51 (that is, the base 50) by fitting them into the recesses, not shown, provided on the inner surface of the above-described pump chamber 19 respectively, and the upper portions of the supporting members 51 are formed with bolt holes 51*c*.

As shown mainly in FIG. 5, the upper surfaces of the side parts 61 are formed with recesses 61*b* for positioning the side parts 61 (that is, the base 50) by fitting them onto the projections, not shown, provided on the bottom of the hull 14.

The boat body 11 is formed with bolt holes opposed to the bolt holes 51*c*, 61*c*.

Therefore, by fitting the projections 51*b* of the supporting members 51 into the recesses on the boat body 11, and fitting the recesses 61*b* of the side parts 61 onto the projections on the boat body 11 respectively, inserting bolts 63 (see FIG. 7) into the bolt holes 51*c*, 61*c* respectively and tightening the same, the supporting members 51 and the side parts 61 are detachably fixed to the boat body 11.

As shown mainly in FIG. 5 and FIG. 6, the inside surfaces of the side parts 61 are formed with shoulders 61*d* extending in the traveling direction of the boat body 11, and both side portions 62*a* of the center part 62 are adapted to be fitted to the shoulders 61*d*.

The center part 62 is formed with bolt holes (through-hole) 62*b* (see FIG. 6), and the side parts 61 are formed with female screw holes 61*e* (see FIG. 5) at the positions corresponding to the bolt holes 62*b*.

Therefore, the center part 62 is detachably fixed to the side parts 61 (that is, the base 50), by fitting the both side portions 62*a* thereof with the shoulders 61*d* of the side parts 61, inserting the bolts into the bolt holes 62*b*, and tightening the same.

As is clear from FIG. 5 and FIG. 6, the setting part 60 is fixed under the base 50 and, as shown in FIG. 6, the bottom surfaces 61*f*, 62*f* of the side parts 61 and the center part 62, which constitute the setting part 60, define part of the bottom surface of the rear portion of the boat body 11.

The rear portion of the center part 62 projects in the shape of a mountain (the shape of Mt. Fuji) toward the rear. An edge 62*c* (see FIG. 6) having a rectifying function is formed from the midsection of the center part 62 toward the rear.

As shown in FIG. 3 to FIG. 6, the front portions of the side parts 61 are connected to each other by a connecting member 90.

As shown in FIG. 3 and FIG. 5, the front portions of the side parts 61, 61 are integrally formed with a pair of arm portions 61*g* of L-shape in plan view. The arm portions 61*g* are formed with bolt holes 61*h*, and the connecting member 90 is formed with bolt holes 91 corresponding to the bolt holes 61*h*.

Therefore, by inserting bolts into the bolt holes and tightening the same, the front portions of the side parts 61 are connected to each other by the connecting member 90.

Projections 92 are provided at the front of the connecting member 90, and rear portion (base portion) 71 of the foreign material preventing plate 70 engages with the projections 92 as shown in FIG. 3. As shown in FIG. 4, the base portion 71 of the foreign material preventing plate 70 and a connecting portion 72 at the front are formed with bolt holes 73, and the bottom of the boat body 11 is formed with bolt holes (not shown) corresponding to the above-described bolt holes 73.

Therefore, by inserting bolts into these bolt holes and tightening the same, the foreign material preventing plate 70 is fixed to the bottom of the boat body 11, and the front portion of the connecting member 90 is securely fixed to the bottom of the boat body 11 with the projections 92 clamped between the base portion 71 of the foreign material preventing plate 70 and the bottom of the boat body 11.

As shown in FIG. 3, a deflector 80 is rotatably mounted to the rear end of the supporting member 51. The supporting member 51 and the deflector 80 are formed with shaft holes 81, and the deflector 80 is rotatably mounted to the supporting member 51 by a shaft (for example, a bolt, not shown) inserted into the shaft holes 81. The deflector 80 is formed with a hole 82 for connection, and a connecting member (a rod, for example) is connected to the hole 82 via a bolt or the like, not shown. The connecting member is connected to a forward-reverse switching element (for example, a switching lever, not shown) to be operated by an occupant sitting on the seat 12, shown in FIG. 1. When the forward-reverse switching element is switched to "forward", the deflector 80 rotates in the direction F indicated by an arrow in FIG. 3, and hence is retracted upward from behind of the steering nozzle 33, so that the forward movement of the boat body 11 is enabled by the jet water flow from the nozzle 33. On the other hand, when the forward-revere switching element is switched to "reverse", the deflector 80 is rotated in the direction R indicated by an arrow in FIG. 3 to be positioned behind the steering nozzle 33, so that the jet water flow from the nozzle 33 is directed toward the front, whereby the reverse movement of the boat body 11 is enabled. The projections 51*b* formed on the outer side surfaces of the supporting members 51 also serve as stoppers for limiting the turning movement of the deflector 80 in the direction R by coming into abutment with the front surface 83 of the arm portion of the deflector 80.

According to the water jet propulsion boat as described above, the following effects are achieved.

Since the water jet propulsion boat 10 includes the pump chamber 19 provided at the rear portion of the boat body 11, the water jet pump 30 accommodated in the pump chamber 19, the ride plate 40 closing the bottom of the pump chamber 19, and the ride plate 40 includes the base 50 to be fixed to the boat body 11, and the setting part 60 detachably fixed to the base 50 and constituting part of the bottom surface of the rear portion of the boat body 11, the following effects are achieved by this arrangement.

That is, when an attempt is made to improve the traveling performance or the turning performance of the water jet propulsion boat 10, it is not necessary to manufacture and replace the entire ride plate 40 itself any longer, and the traveling performance and/or the turning performance of the water jet propulsion boat 10 can be improved by manufacturing and replacing only the setting part 60 (in particular, the center part 62).

In addition, by attaching a suitable setting part (smaller than the entire ride plate) 60 depending on the machine type of the water jet propulsion boat 10, the performance specific to each type of boats can easily be demonstrated.

Furthermore, by fixing the setting part 60 under the base 50, and constituting part of the bottom surface of the rear portion of the boat body 11 by the bottom surfaces 61*f*, 62*f* of the setting part 60, a preferable sliding surface can easily be obtained.

Still further, by constituting the base 50 by the pair of left and right bases 51, and constituting the setting part 60 by the pair of left and right side parts 61 to be fixed to the bases 51 and the center part 62 to be detachably fixed to the side parts 61, steering stability and improvement of the maximum speed can easily be achieved by replacing only the center part 62 constituting the center portion which affects the steering stability and the maximum speed very much.

In other words, by replacing only the center part 62, which is much smaller than the entire ride plate 40, the steering stability and improvement of the maximum speed can easily be achieved.

Also, when changing the setting of the bottom shape of the ride plate 40, the setting can be changed by replacing only the setting part 62 at the lower side or at the center without changing the base 50 (and the side parts 61 which constitute the base) which is relatively large and hence requires high cost for a mold.

In addition, it is not necessary to manufacture the ride plates with new molds for the respective machine types, and it becomes possible to share the base 50 ensured strength in common and to adapt to the respective settings for exploiting machine-type-specific performance by attaching the relatively small setting part 60 (in particular the center part 62).

Figure 7A:
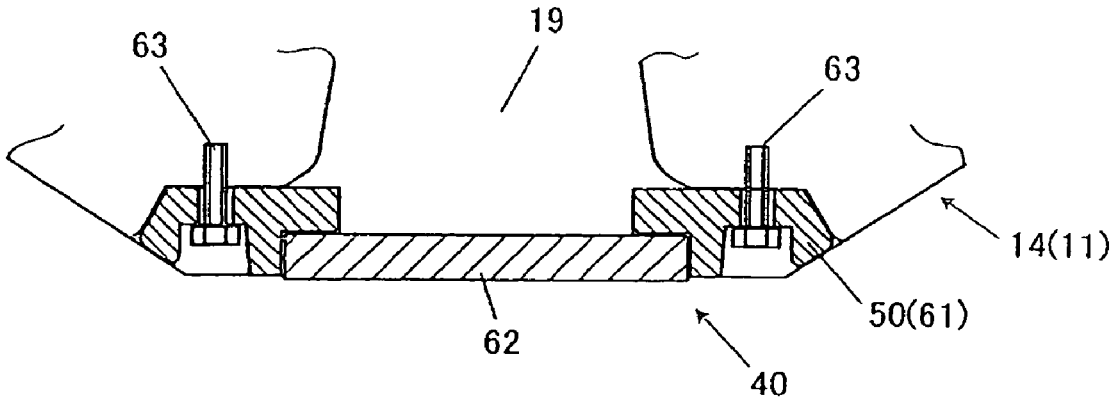
FIG. 7(*a*) is a diagrammatic cross-section viewed from behind a boat body and FIG. 7(*b*) is a diagrammatic drawing showing another embodiment viewed from behind the boat body.
Figure 7B:
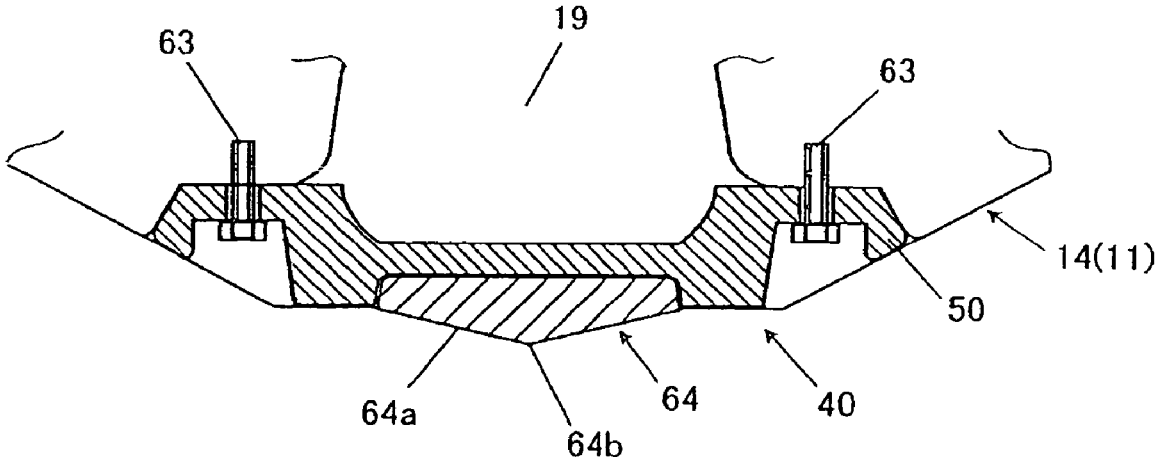

FIG. 7(*a*) shows the embodiment described above in diagrammatic cross-section viewed from the rear of the boat body 11. While, as shown in FIG. 7(*b*), it is also possible to provide a function as the ride plate 40 to the base 50, detachably (selectively) fix the setting part 64 under the base 50, and constitute the part of the bottom of the rear portion of the boat body 11 by the bottom surface 64*a* of the setting part 64.

With the embodiment shown in FIG. 7(*b*) as well, the same effects as in the previous embodiment can be obtained.

According to the embodiment shown in FIG. 7(*b*), since the base 50 constitutes the ride plate 40 (the base 50 has a function as the ride plate 40) even when the setting part 64 is removed, the water jet propulsion boat 10 can be traveled in this state.

Also, since the setting part of suitable shape can be selectively mounted according to the setting of the traveling functions (direct-traveling performance, turning performance, high-velocity performance), by mounting the setting part 64 of a substantially inverted triangular cross-section whose single bottom edge (ridge) 64*b* corresponds the bottom edge of the boat body 11, for example, as shown in FIG. 7(*b*), improvement of the turning performance and the maximum speed is achieved.

Although the embodiments of the present invention have been described thus far, the present invention is not limited to the above-described embodiments, and may be modified as needed within the scope of the present invention.

For example, it is also possible to form the supporting member 51 and the side parts 61 integrally with each other, thereby constituting the base.

In this detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

We claim:

1. A water jet propulsion boat, comprising:

a pump chamber provided at a rear portion of a boat body of the boat;

a water jet pump disposed in said pump chamber;

a ride plate closing a bottom of said pump chamber, said ride plate including a base fixable to the boat body; and a setting plate detachably fixed to said base, and forming part of a bottom surface of the rear portion of the boat body.

2. The water jet propulsion boat according to claim 1, wherein said setting part is fixed under said base, such that a bottom surface of said setting part constitutes part of the bottom surface of the rear portion of the boat body.

3. A water jet propulsion boat according to claim 2, wherein said base includes a pair of left and right bases, and said setting part includes a pair of left and right side parts to be fixed to said base and a center part to be detachably fixed to the side parts.

4. A water jet propulsion boat according to claim 1, wherein said base includes a pair of left and right bases, and said setting part includes a pair of left and right side parts to be fixed to said base and a center part to be detachably fixed to the side parts.

* * * * *